US011261623B1

(12) United States Patent
Giles

(10) Patent No.: US 11,261,623 B1
(45) Date of Patent: Mar. 1, 2022

(54) APPARATUS FOR SECURING A SHEET ROLL

(71) Applicant: Kenneth Giles, Bronx, NY (US)

(72) Inventor: Kenneth Giles, Bronx, NY (US)

( * ) Notice: Subject to any disclaimer, the term of this patent is extended or adjusted under 35 U.S.C. 154(b) by 348 days.

(21) Appl. No.: 16/598,034

(22) Filed: Oct. 10, 2019

(51) Int. Cl.
*E05B 73/00* (2006.01)
*B65H 16/06* (2006.01)

(52) U.S. Cl.
CPC ..... *E05B 73/0005* (2013.01); *B65H 16/06* (2013.01)

(58) Field of Classification Search
CPC ..... E05B 73/0005; E05B 73/0011; E05B 73/0029; E05B 71/00; B65H 16/06
USPC ..... 70/14, 18, 30, 49, 58, 233
See application file for complete search history.

(56) References Cited

U.S. PATENT DOCUMENTS 4,066,231 A * 1/1978 Bahner ..... B43M 99/00 248/289.11
2005/0127083 A1* 6/2005 Russell ..... B65H 35/002 221/30
2005/0223756 A1* 10/2005 Ling ..... E05B 73/0011 70/30
2005/0241348 A1* 11/2005 Devecki ..... B63C 11/02 70/18
2006/0032276 A1* 2/2006 Early ..... E05B 73/0005 70/58
2008/0040898 A1* 2/2008 Stolk ..... B60P 7/0823 24/298
2008/0053168 A1* 3/2008 Lu ..... E05B 73/0005 70/58
2008/0072633 A1* 3/2008 Samuel ..... E05B 73/0005 70/58
2008/0163654 A1* 7/2008 Avganim ..... E05B 73/0082 70/58
2012/0103031 A1* 5/2012 Grant ..... E05B 73/0005 70/14

FOREIGN PATENT DOCUMENTS

EP 0256237 * 2/1988

* cited by examiner

*Primary Examiner* — Lloyd A Gall
(74) *Attorney, Agent, or Firm* — Sanchelima & Associates, P.A.; Christian Sanchelima; Jesus Sanchelima

(57) ABSTRACT

An apparatus for securing a wrap or sheet roll is disclosed. The apparatus includes a cable in which a first end of the cable is mounted to a structure and a second end of the cable is mounted to a base plate. The apparatus further includes a lock notch provided at the cable. The apparatus has a lock pin removably mounted to the lock notch. The apparatus also has a lock plate mounted to the cable. The apparatus includes a sheet roll mounted to the cable as well. The sheet roll is mounted to the cable by drawing the base plate through an opening provided at the sheet roll. The lock plate is placed above the sheet roll and the lock pin is mounted to the lock notch to secure position of the sheet roll between the lock plate and the base plate.

7 Claims, 8 Drawing Sheets

APPARATUS FOR SECURING A SHEET ROLL

BACKGROUND OF THE INVENTION

1. Field of the Invention

The present disclosure relates to securing wraps or sheet rolls. More specifically, the present disclosure relates an apparatus used for securing a sheet roll or wrap to a variety of structures.

2. Description of the Related Art

It is known that a sheet roll or wrap indicates a quantity of fabric or paper or plastic or sheet or metal rolled up to form a single package. The wraps are used for a variety of purposes. For example, the wraps are used in packaging industries to wrap a sheet around a batch of products for ease of shipping from one place to another. In another example, a wrap comprising a roll of adhesive tape might be used for mounting two or more components. In yet another example, a wrap comprising a roll of plastic sheet might be used in construction and/or transportation industry.

Typically, the sheet rolls or wraps are carried from one place to another place in a container. Upon reaching a desired destination, the wraps are kept on racks. When needed, the wraps are removed from the racks and put back in place after use. As known, the wraps kept on the racks are susceptible to theft, as the wraps are not secured to any other objects or stored in containers kept at presumably safe places. Several designs for pallet wrap storage devices have been designed in the past. None of them, however, include a pallet wrap securing device comprising a pallet wrap roll holder and dispenser having a fastener device on the top and the bottom of the wrap dispenser, where the fasteners have integral locking elements.

As specified above, generally the wraps are stored in cases or boxes. An example of a case is disclosed in a United States patent application 20050127083. In US20050127083A1, it is disclosed that a closeable storage case for holding sheet material such as gift-wrapping paper and other related wrapping accessories. The storage case has at least one section that includes spaced apart roll retainers for rotatably mounting rolls of wrapping paper between them. The roll retainers include a support bracket and a roll engaging mechanism. The storage case includes a cutter mechanism for cutting sections of sheet material from the rolls held within the case and may also include compartments for securing adhesive tape and ribbon therein.

In another example, a plurality of wraps is stored in a case/package for carrying the wraps from one place to another. Such an example is disclosed in a European patent application 0256237. In EP0256237A2, it is disclosed that the package has at least two rolls arranged adjacently. The sheets are wound into rolls with a continuous opening. One holding element is arranged in each case on the outside of the two rolls lying on the outside in each case. The holding elements are detachably connected to each other by means of a connection element that projects through the openings of the rolls.

Although the cases are useful in storing the wraps, they have few disadvantages. For instance, the wraps used in the shipping and transportation industry are huge; as a result, the storage cases used for storing them take considerable space. Further, there is a risk of the cases containing the wraps getting stolen. Further, there is a risk of unauthorized users using the wraps if they are not secured in a room or to a structure.

Other documents describing the closest subject matter provide for a number of more or less complicated features that fail to solve the problem in an efficient and economical way. None of these patents suggest the novel features of the present invention. Specifically, none of the disclosures in the art disclose an apparatus that can be used to secure sheet rolls or wraps to a variety of structures.

Therefore, there is a need in the art for an apparatus that allows to secure sheet rolls or wraps to a variety of structures and prevent the wraps from getting stolen or be used by unauthorized personnel.

SUMMARY OF THE INVENTION

It is one of the objects of the present invention to provide an apparatus that can be used to secure sheet rolls or wraps and avoids the drawbacks of the prior art.

It is another object of the present invention to provide an apparatus that can be used to secure sheet rolls or wraps to a variety of structures such as frames, walls or poles and so on. The apparatus comprises a cable made of a flexible or rigid structure, which allows the apparatus to be mounted to the variety of structures.

It is yet still another object of the present invention to provide an apparatus that can be removably secured to variety of structures for securely mounting sheet rolls or wraps.

It is still another object of the present invention to provide an apparatus that allows only authorized personnel to access the sheet rolls or wraps and to prevent the sheet rolls from getting stolen. The apparatus is provided with a lock such as a numeric or combination lock to lock or unlock the lock so that only authorized personnel can access the sheet rolls.

It is one object of the present invention to secure sheet rolls to a structure without damaging the sheet rolls.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus for securing a wrap or sheet roll. The apparatus comprises a cable in which a first end of the cable is mounted to a structure such as a frame and a second end of the cable is mounted to a base plate. The apparatus further comprises a lock notch provided at the cable. The apparatus further comprises a lock pin removably mounted to the lock notch. The apparatus further comprises a lock plate mounted to the cable. The apparatus further comprises a sheet roll mounted to the cable. The sheet roll is mounted to the cable by drawing the base plate through an opening provided at the sheet roll. The lock plate is placed above the sheet roll and the lock pin is mounted to the lock notch to secure position of the sheet roll between the lock plate and the base plate.

Various features and embodiments of an apparatus for securing a wrap or sheet roll are explained in conjunction with the description of FIGS. 1-8.

Figure 1:
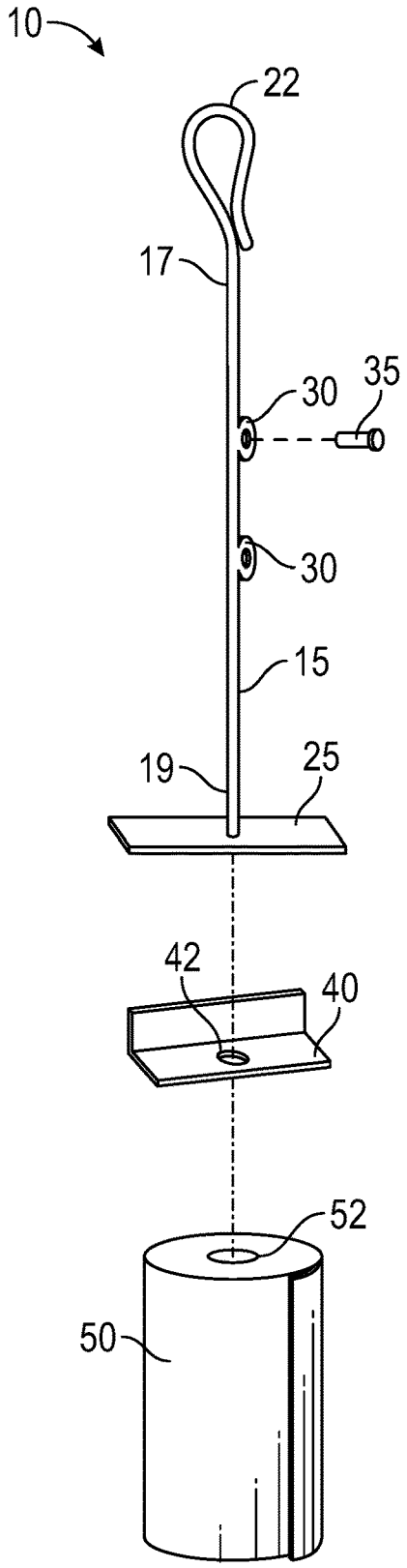
FIG. 1 illustrates an exploded view of an apparatus for securing wraps or sheet rolls, in accordance with one embodiment of the present disclosure.

Referring to FIG. 1, an exploded view of an apparatus 10 for securing a wrap or a sheet roll is shown, in accordance with one embodiment of the present disclosure. The apparatus 10 comprises a cable 15. The cable 15 might indicate a steel cable, a rope made of fabric or any other suitable material. In one example, the cable 15 might be made of a flexible or rigid material. The cable 15 comprises a first end 17 and a second end 19. At the first end 17, the cable 15 is provided with a loop 22. In order to form the loop 22, the first end 17 of the cable 15 is bent and affixed to the cable 15 using known mechanisms such as adhesives, fasteners and so on.

Further, the apparatus 10 is provided with a base plate 25 at the second end 19 of the cable 15. The base plate 15 is made up of metal, wood, plastic or any other suitable material. The base plate 15 is provided in an elongated structure, preferably in a rectangular structure. The base plate 25 might be mounted to the cable 15 using known mechanism such as fasteners or adhesive. Alternatively, the base plate 15 might be provided with an opening to draw the cable 15 for mounting the base plate 25 to the cable 15. Further, the apparatus 10 comprises a lock notch 30 at the cable 15. It should be understood that the cable 15 could be provided more than one lock notch 30 at its length. The lock notch 30 might be provided in a ring like structure i.e., circular structure. The lock notch 30 might be made of metal, wood, plastic or any other suitable material. It should be understood that the lock notch 30 is mounted to the cable 15 using known mechanisms e.g., fasteners. It should be understood that the lock notch 30 is movable or adjustable along the length of the cable 15.

Further, the apparatus 10 comprises a lock pin 35. The lock pin 35 may indicate a lever insertable in the lock notch 30. Further, the apparatus 10 comprises a lock plate 40. The lock plate 40 might be made of metal, wood, plastic or any other suitable material. The lock plate 40 is provided in a L-shaped structure. Alternatively, the lock plate 40 might be provided in an elongated structure e.g., in a rectangular structure. The lock plate 40 is provided with a first opening 42. The first opening 42 is provided in a circular or oval shape for receiving the cable 15 therethrough. It should be understood that the lock notch 30 is mounted to the lock plate 40 and the lock pin 35 is inserted into the lock notch 30 to lock the position of the lock plate 40 at the cable 15.

The apparatus 10 further comprises a sheet roll or a wrap 50. The sheet roll 50 may indicate a quantity of fabric or paper or plastic or sheet or metal rolled up to form a single package. The sheet roll 50 may include, but not limited to, a plastic roll, a fabric roll, a paper roll, sheet metal roll and so on. As known, the sheet roll 50 may include a second opening 52. The second opening 52 might indicate a tube that is used to wound a quantity of sheet to form the sheet roll.

Figure 2:
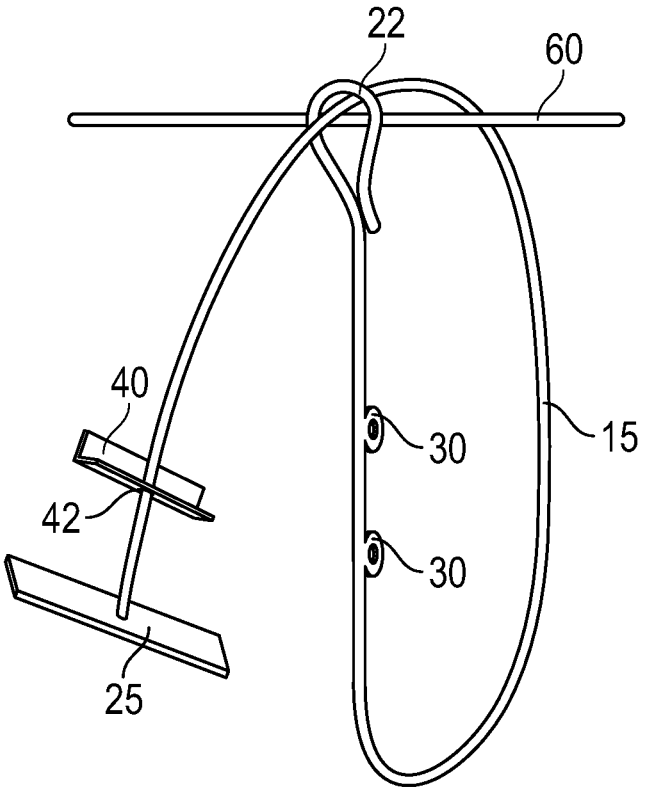
FIG. 2 illustrates mounting of a cable to a structure such as a frame, in accordance with one embodiment of the present disclosure.
Figure 3:
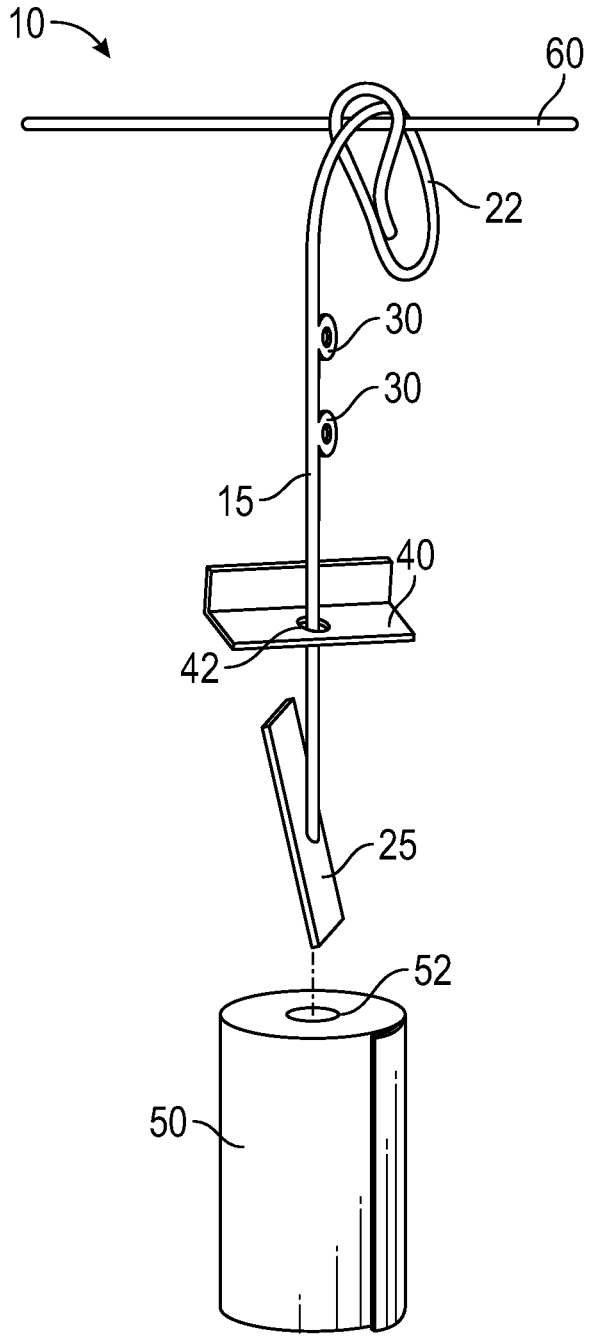
FIG. 3 illustrates a sheet roll aligned with a base plate for mounting the sheet roll to the cable, in accordance with one embodiment of the present disclosure.
Figure 4:
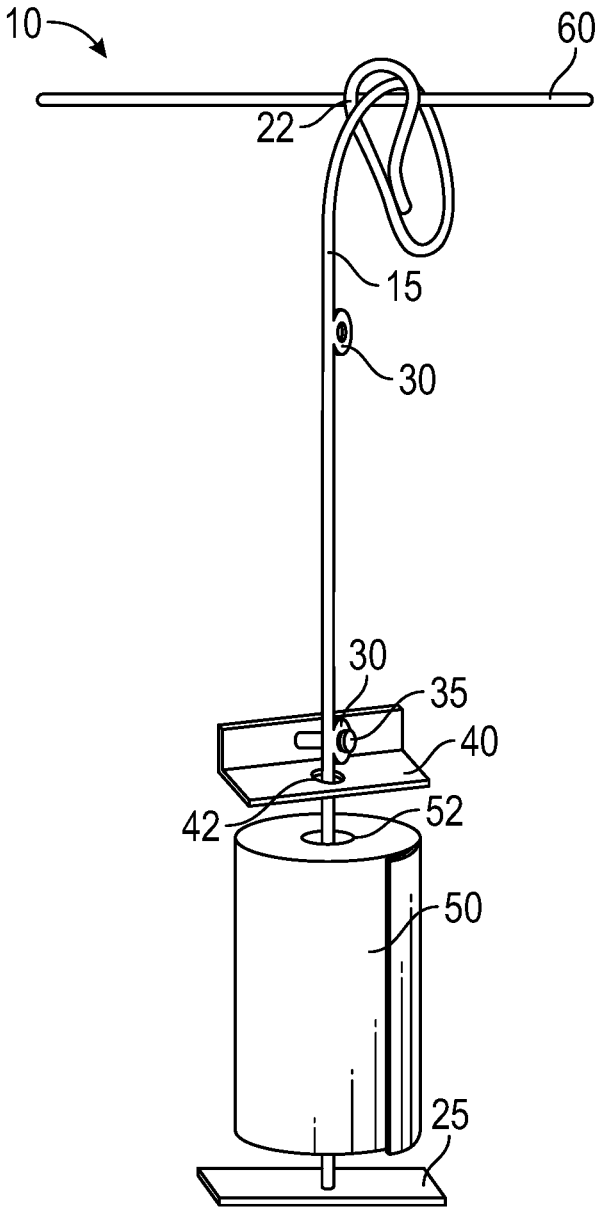
FIG. 4 illustrates the apparatus mounted to the frame for securing the sheet roll, in accordance with one embodiment of the present disclosure.

Now referring to FIGS. 2, 3 and 4, assembling the apparatus 10 and mounting the apparatus 10 to a structure such as a frame 60 for securing the sheet roll 50 is explained. In order to mount the apparatus 10 to the frame 60, at first, the second end 19 of the cable 15 is drawn through the first opening 42 of the lock plate 40. Subsequently, the base plate 25 is mounted to the second end 19 of the cable 15. After mounting the base plate 25 and the lock plate 40, the loop 22 is positioned next to the frame 60 and the second end 19 of the cable 15 is drawn through the loop 22 so as form a knot at the first end 17 of the cable 15 to mount the cable 15 to the frame 60, as shown in FIG. 2.

Subsequently, the sheet roll 50 is aligned with the base plate 25 and the base plate 25 is tilted to be drawn through the second opening 52 of the sheet roll 50, as shown in FIG. 3. It should be understood that when the base plate 25 is drawn through the second opening 52, the cable 15 is also drawn through the second opening 52 thereby mounting the sheet roll 50 to the cable 15.

After mounting the sheet roll 50 to the cable 15, the base plate 25 is positioned in a horizontal configuration, as shown in FIG. 4. Subsequently, the lock plate 40 is positioned in a horizontal configuration above the sheet roll 50 such that the sheet roll 50 is placed between the base plate 25 and the lock plate 40. After positioning the lock plate 40 above the sheet roll 50, the lock notch 30 might be placed above lock plate 40. Subsequently, the lock pin 35 is inserted into the lock notch 30 to lock the position of the lock plate 40 such that the sheet roll 50 is locked or secured between the base plate 25 and the lock plate 40, as shown in FIG. 4. It should be understood that the when the apparatus 10 is mounted to the frame 60, the sheet roll 50 is made to hang to the frame 60 with the help of the cable 15. Further, it should be understood that when the apparatus 10 is mounted to the frame 60, the base plate 25 and the lock plate 40 ensure that the sheet roll 50 is not removable from the cable 15, as the lock plate 40 does not allow a user to tilt the base plate 25 to remove the sheet roll 50. This way, the sheet roll 50 is secured to the frame 60 with the help of the base plate 25, the lock plate 40 and the cable 15.

In order to remove the sheet roll 50 from the cable 15, at first, a user may remove the lock pin 35 from the lock notch 30. Subsequently, the user may raise the lock plate 40 for lifting the sheet roll 50. Thereafter, the user may turn the base plate 25 in a vertical configuration to remove the sheet roll 50 by withdrawing the base plate 25 through the second opening 52 of the sheet roll 50.

In one example, the lock pin 35 is provided with a locking mechanism such as a numeric or combination lock such that the user may have to align the numeric digits in a predetermined pattern to remove the lock pin 35 from the lock notch 30. The locking mechanism at the lock pin 35 ensures that only authorized personnel can mount or demount the sheet roll 50 to the cable 15 and secure the sheet roll 50 between the base plate 25 and the lock plate 40.

As the cable 15 allows the user to bend and put knot, the cable 15 can be mounted to the frame 60 or any other structure that is in a closed structure. As such, the cable 15 can be mounted to any structure that might be available in a shipping or any other industry. As such, the apparatus 10 allows securing the sheet roll 50 with the help of the cable 15, the base plate 25, and the lock plate 40.

Figure 5:
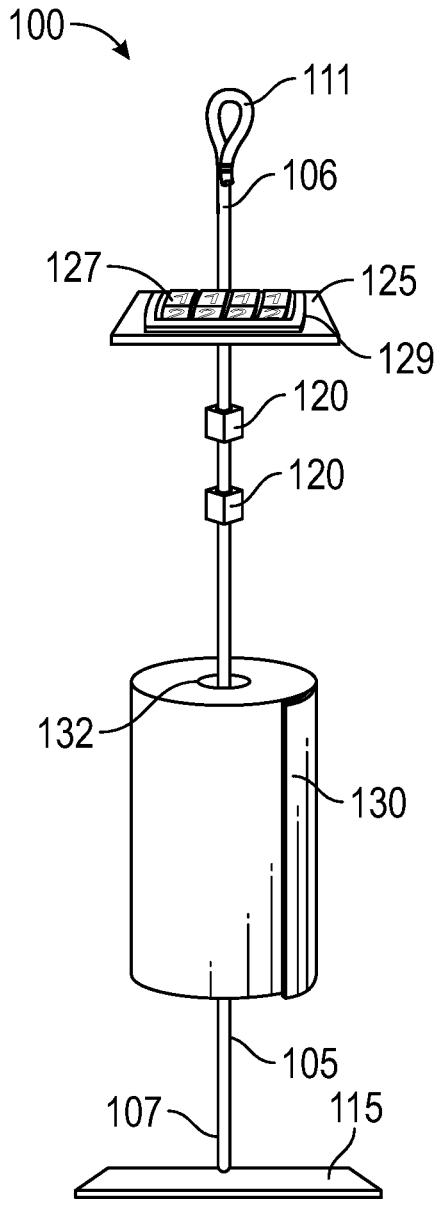
FIG. 5 illustrates a perspective view of an apparatus for securing sheet rolls, in accordance with another embodiment of the present disclosure.

Now referring to FIG. 5, a perspective view of an apparatus 100 for securing wraps or sheet rolls is shown, in accordance with another embodiment of the present disclosure. The current embodiment is provided to explain use of a numeric or combination lock to securely lock the sheet roll to a structure. In the current embodiment, the apparatus 100 comprises a cable 105. The cable 105 might indicate a steel cable, rope made up of fabric or any other suitable material. The cable 105 comprises a first end 106 and a second end 107. At the first end 106, the cable 15 is provided with a loop 111.

Further, the apparatus 100 is provided with a base plate 115 at the second end 107 of the cable 105. The base plate 115 is provided in an elongated structure, preferably in a rectangular structure. Further, the apparatus 100 comprises a lock notch 120. It should be understood that more than one lock notch 120 might be provided at the cable 105. The lock notch 120 might be provided in a square shape. However, it should be understood that the lock notches 120 might be provided in any other shape. The lock notch 120 might be made of metal, wood, plastic or any other suitable material. Further, the apparatus 100 comprises a lock plate 125. The lock plate 125 might be made of metal, wood, plastic or any other suitable material. The lock plate 125 is provided in a rectangular or square shape. Alternatively, the lock plate 125 might be provided in an elongated structure e.g., in a rectangular structure.

The apparatus 100 further comprises a lock 127, for example a numeric or combination lock as known in the art. In one example, the lock 127 may include a combination lock in which a sequence of symbols or numbers or combination thereof is used to open the lock 127. In order to open the lock 127, a user may enter or turn the sequence using a single rotating dial, which interacts with several discs or cams, by using a set of several rotating discs with inscribed symbols which directly interact with the locking mechanism, or through an electronic or mechanical keypad. In one embodiment, there may be a pad 129 mounted around lock 127 and thereon lock plate 125. Pad 129 may be mounted flush around lock 127. In an alternate embodiment, pad 129 may be mounted entirely underneath lock 127. Pad 129 is adapted to provide protection to lock 127.

Further, the apparatus 100 further comprises a sheet roll 130. The sheet roll 130 may indicate a wrap including, but not limited to, a plastic roil, a fabric roll, a paper roll, sheet metal roll and so on. As known, the sheet roll 130 may include a second opening 132. The second opening 132 might indicate a tube that is used to wound a quantity of sheet to form the sheet roll.

In order to mount the sheet roll 130 to the cable 105, a user of the apparatus 100 may position the base plate 115 in a vertical configuration. Subsequently, the user may draw the sheet roll 130 via the second opening 132 to mount the sheet roll 130 to the cable 105. Afterwards, the user may place the lock plate 125 above the sheet roll 130 and use the lock 127 to lock the position of the lock plate 125 such that the sheet roll 130 is made to sit between the base plate 115 and the lock plate 125. As the base plate 115 and the lock plate 125 are positioned in proximity to the sheet roll 130, the base plate 115 cannot be positioned in a vertical configuration to remove the sheet roll 130 from the cable 105.

In order to remove the sheet roll 130, the user has to enter or set the sequence symbols or numbers at the lock 127 to raise the lock plate 125 for removing the sheet roll 130 from the cable 105 via the base plate 115. As specified above, the lock 127 might be configured with a plurality of sequences of symbols or numbers for opening the lock 127. Each sequence might be provided or assigned to different users such each user may enter or arrange the sequence using the single rotating dial for opening the lock 127. After arranging the sequence, the user may lift the lock plate 125 for removing the sheet roll 130 from the cable 105.

Figure 6:
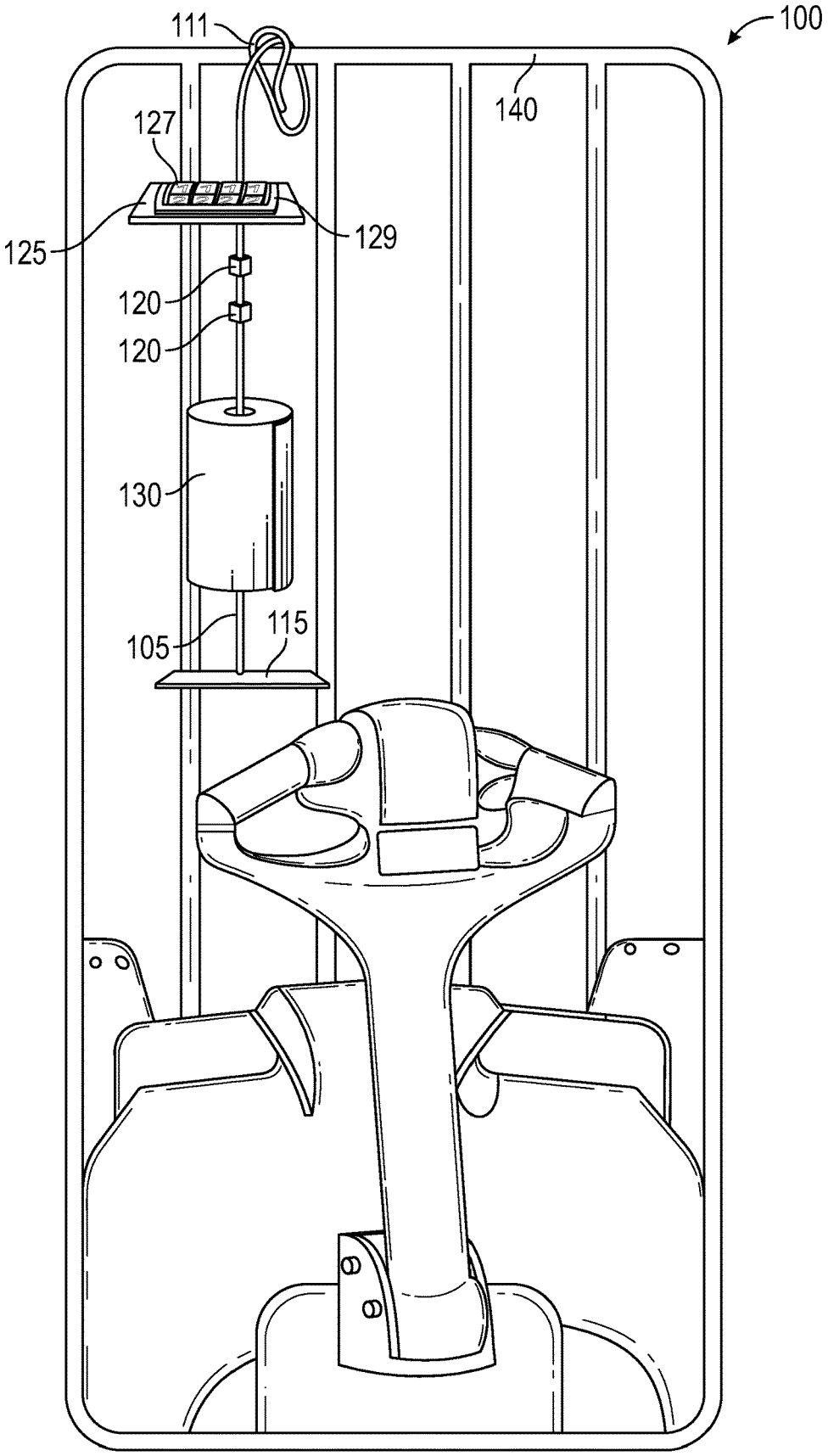
FIG. 6 illustrates the apparatus mounted to a frame, in accordance with one exemplary embodiment of the present disclosure.

Now referring to FIG. 6, the apparatus 100 mounted to a frame 140 for securing the sheet roll 130 is shown. As can be seen, the loop 111 might be mounted to the frame 140 provided in a ship or any other structure. Subsequently, the user may draw the sheet roll 130 via the second opening 132 to mount the sheet roll 130 to the cable 105. Further, the user may place the lock plate 125 above the sheet roll 130 and use the lock 127 to lock the position of the lock plate 125 such that the sheet roll 130 is made to sit between the base plate 115 and the lock plate 125. Subsequently, the user may arrange the lock 127 in a random manner so as to lock the lock plate 125 and thereby securely locking position of the sheet roll 130 to the cable 105 and the frame 140.

Figure 7:
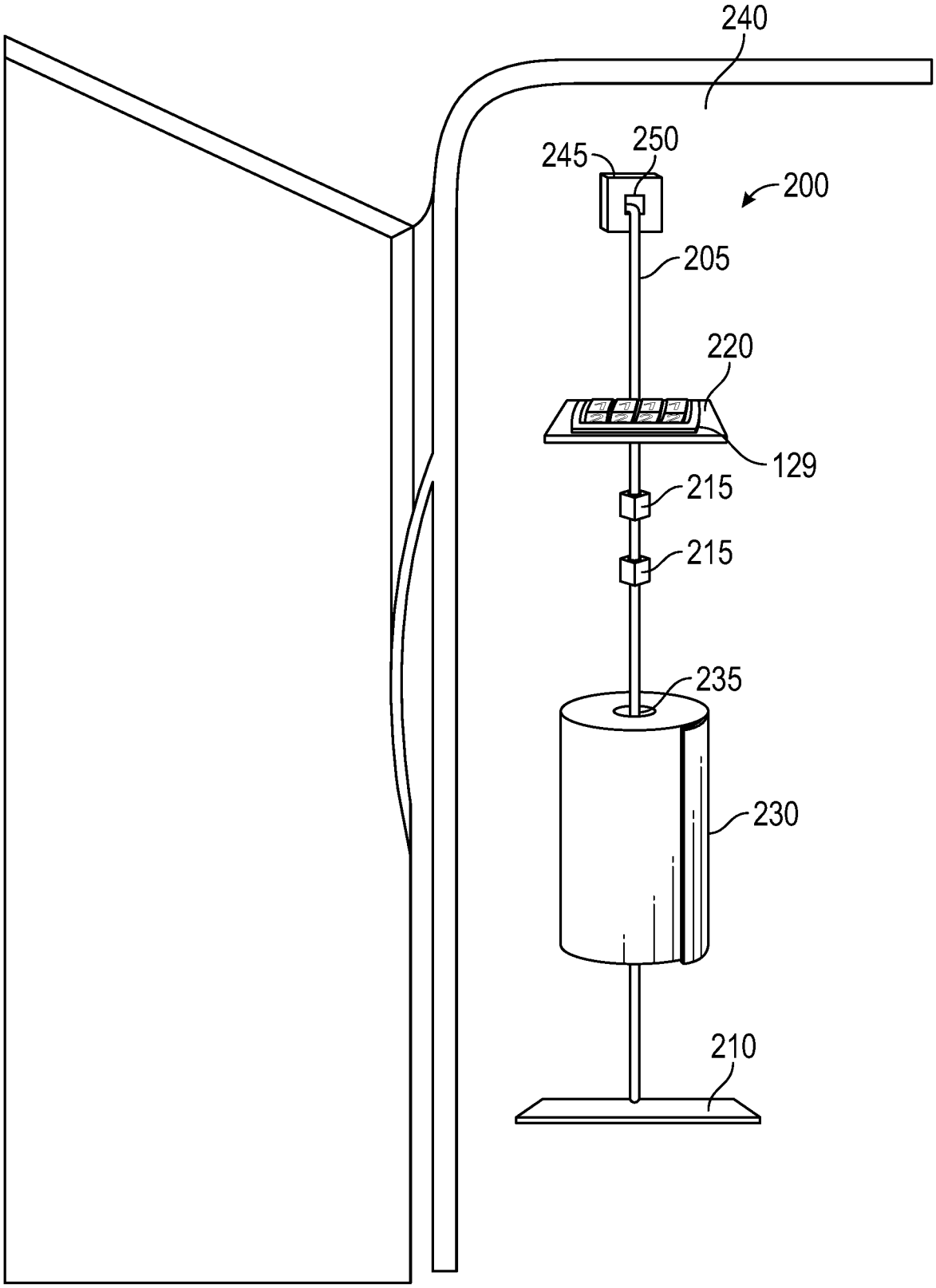
FIG. 7 illustrates an apparatus mounted to a structure such as a wall, in accordance with another exemplary embodiment of the present disclosure.

Referring to FIG. 7, a perspective view of an apparatus 200 for securing wraps or sheet rolls is shown, in accordance with one exemplary embodiment of the present disclosure. In the current embodiment, the apparatus 200 comprises a cable 205. One end of the cable 205 is mounted to a bracket 245 provided at a structure 240 such as a wall or door. In one example, the bracket 245 might be provided with an opening 250 for mounting the cable 205. The other end of the cable 205 is mounted to a base plate 210. As explained above, the apparatus 200 is provided with a lock notch 215. The lock notch 215 might be provided in a square shape. However, it should be understood that the lock notch 215 might be provided in any other shape. Further, the apparatus 200 comprises a lock plate 220. The lock plate 220 might be made of metal, wood, plastic or any other suitable material. The lock plate 220 might be provided with a lock, similar to lock 127. Further, the apparatus 200 further comprises a sheet roll 230. The sheet roll 230 may indicate a wrap including, but not limited to, a plastic roll, a fabric roll, a paper roll, sheet metal roll and so on. As known, the sheet roll 230 may include a second opening 235. The second opening 235 might indicate a tube that is used to wound a quantity of sheet to form the sheet roll.

In order to mount the sheet roll 230 to the cable 205, a user of the apparatus 200 may position the base plate 210 in a vertical configuration. Subsequently, the user may draw the sheet roll 230 via the second opening 235 to mount the sheet roll 230 to the cable 205. Thereafter, the user may place the lock plate 220 above the sheet roll 230 and use the lock to secure the position of the lock plate 220 such that the sheet roll 230 is made to sit between the base plate 210 and the lock plate 220. As the base plate 210 and the lock plate 220 are positioned in proximity to the sheet roll 230, the base plate 210 cannot be positioned in a vertical configuration to remove the sheet roll 230 from the cable 205. In order to remove the sheet roll 230, the user has to enter or set the sequence symbols or numbers at the lock 127 to raise the lock plate 220 for removing the sheet roll 230 from the cable 205.

Figure 8:
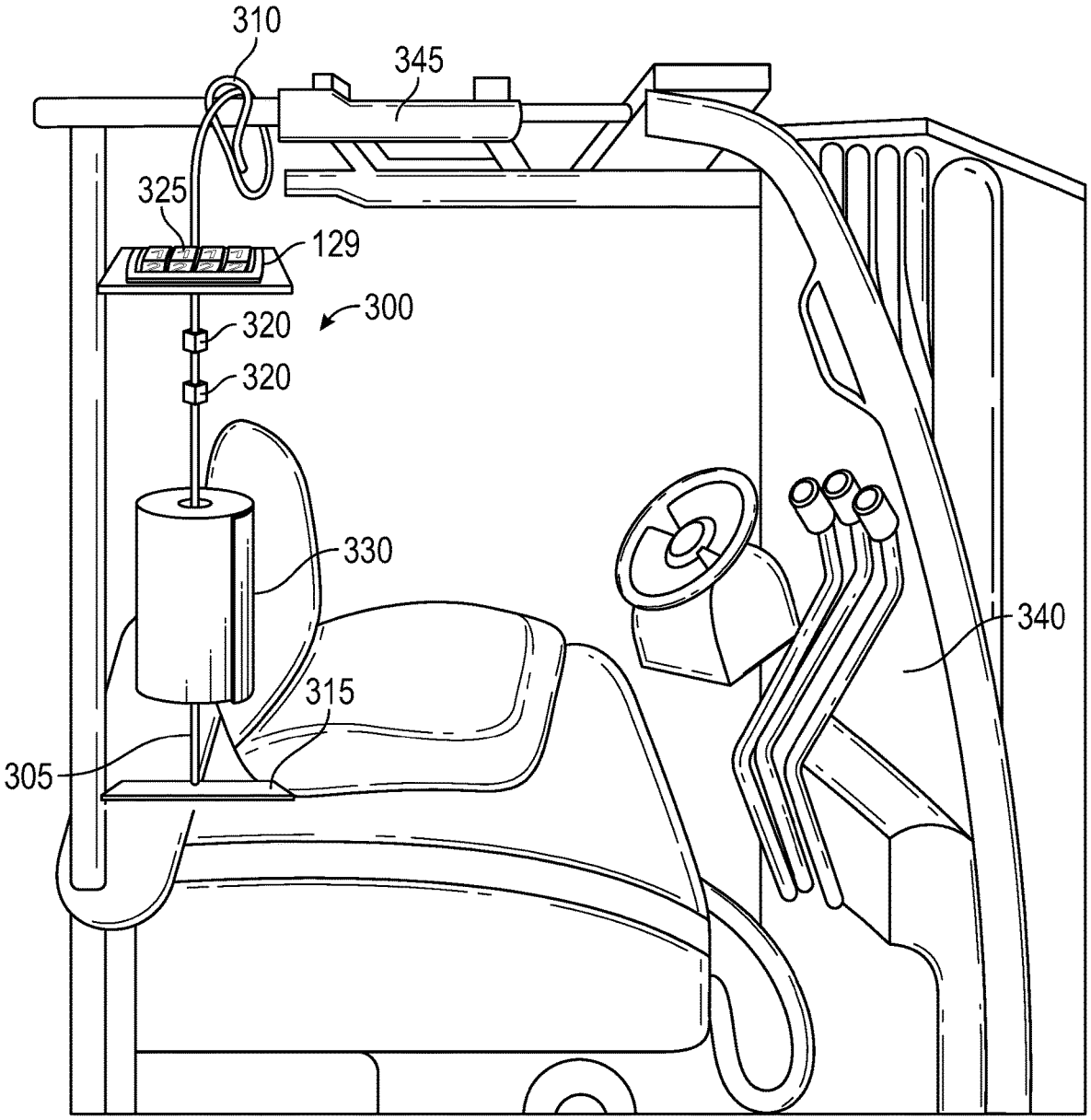
FIG. 8 illustrates an apparatus mounted to a frame at a vehicle, in accordance with another exemplary embodiment of the present disclosure.

Referring to FIG. 8, an apparatus 300 for securing a wrap or sheet roll in a vehicle 340 is shown, in accordance with another exemplary embodiment of the present disclosure. The apparatus 300 comprises a cable 305. One end of the cable 305 comprises a loop 310 used to mount the cable 305 to a frame 345 in the vehicle 340. Further, other end of the cable 305 is mounted to a base plate 315. As explained above, the apparatus 300 is provided with a lock notch 320. The lock notch 320 might be provided in a square shape. However, it should be understood that the lock notch 320 might be provided in any other shape. Further, the apparatus 300 comprises a lock plate 325. The lock plate 325 might be made up of metal, wood, plastic or any other suitable material. The lock plate 325 might be provided with a lock, similar to lock 127. Further, the apparatus 300 further comprises a sheet roll 330. The sheet roll 330 may indicate a wrap including but not limited to a plastic roll, a fabric roll, a paper roll, sheet metal roll and so on. As known, the sheet roll 330 may include a second opening.

In order to mount the sheet roll 330 to the cable 305, a user of the apparatus 300 may position the base plate 315 in a vertical configuration. Subsequently, the user may draw the sheet roll 330 via the second opening to mount the sheet roll 330 to the cable 305. The user may then place the lock plate 325 above the sheet roll 330 and use the lock to lock the position of the lock plate 325 such that the sheet roll 330 is made to sit between the base plate 315 and the lock plate 325. As the base plate 315 and the lock plate 325 are positioned in proximity to the sheet roll 330, the base plate 315 cannot be positioned in a vertical configuration to remove the sheet roll 330 from the cable 305. In order to remove the sheet roll 330, the user has to enter or set the sequence symbols or numbers at the lock to raise the lock plate 325 for removing the sheet roll 330 from the cable 305.

Based on the above, it should be evident that the apparatus allows securing the sheet roll or wrap to any structure and to safely provide access to authorize users for removing the sheet roll. As such, the apparatus might be used in any industry for example, shipping industry, trucks or at homes by mounting the apparatus to structures such as doors or frame.

As the apparatus is mounted to structures such as frames placed at certain height from the ground, the sheet roll is secured to the frame without damaging the sheet roll.

Further, it should be understood that other type of locking mechanisms might be provided at the lock plate for locking the position of the lock plate to restrict movement of the sheet roll. As explained above, the locking mechanism might be configured in such a way that multiple users can be provided with unique identification numbers for accessing the locks and to remove the sheet rolls from the apparatus. For example, the locking mechanism might be configured to recognize the users with their employee identification numbers. The users may enter their employee identification number to unlock the locking mechanism and remove the sheet roll as using the explanation provided above. In one example, the locking mechanism might be provided with a digital access for example fingerprint access or facial recognition. The digital access allows keeping a track of details such as date and time of access of each user accessing the locking mechanism to mount or demount the sheet roll from the apparatus.

Although it is shown that the apparatus comprises a cable which is used to receive the sheet roll or the wrap, an elongated rod might be used in which one end is removably or permanently mounted to a structure or frame and other end is used to mount the base plate. The base plate might be drawn through the opening provided at the sheet roll to mount the sheet roll to the elongated rod. Additionally, the lock plate might be removably or permanently mounted to the cable for locking the position of the sheet roll to the elongated rod.

It should be understood that the drawings are provided for illustrative purpose only and should be construed in limited sense. A person skilled in the art will appreciate that the alternate embodiments with varying components might be used to implement the embodiments described herein and such implementations are within the scope of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for an apparatus for securing a sheet roll, comprising:

a cable, wherein a first end of the cable is mounted to a structure and a second end of the cable is mounted to a base plate;

a lock notch provided at the cable;

a lock pin removably mounted to the lock notch;

a lock plate mounted to the cable; and a sheet roll, wherein the sheet roll is mounted to the cable by drawing the base plate through an opening provided at the sheet roll, and wherein the lock plate is placed above the sheet roll and the lock pin is mounted to the lock notch to secure the position of the sheet roll between the lock plate and the base plate.

2. The system of claim 1, wherein the cable comprises a loop at the first end.

3. The system of claim 1, wherein the cable is used to put a knot to secure the cable to the structure.

4. The system of claim 1, wherein the lock pin comprises a locking mechanism for operating the lock pin.

5. The system of claim 1, wherein the position of the lock notch and the lock plate are adjustable along the length of the cable.

6. A system for an apparatus for securing a roll, comprising:

a cable, wherein one end of the cable is mounted to a structure and other end of the cable is mounted to a base plate;

a lock;

a lock notch provided at the cable;

a lock plate mounted to the cable, said lock mounted thereon said lock plate; and a sheet roll, said sheet roll is mounted to the cable by drawing the base plate through an opening provided at the sheet roll, wherein the lock notch is positioned above the sheet roll and the lock plate is used to secure the position of the sheet roll between the lock notch and the base plate.

7. The system of claim 6, wherein a pad is mounted flush around said lock for protection of said lock.

* * * * *